US008505207B2

(12) United States Patent
Thien

(10) Patent No.: US 8,505,207 B2
(45) Date of Patent: Aug. 13, 2013

(54) CUTTING KNIFE, IN PARTICULAR FOR CUTTING FOOD

(75) Inventor: Gerhard Thien, Beeskow (DE)

(73) Assignee: Forschungs- und Entwicklungsgesellschaft für technische Produckte GmbH & Co. KG, Beeskow (DE)

( * ) Notice: Subject to any disclaimer, the term of this patent is extended or adjusted under 35 U.S.C. 154(b) by 849 days.

(21) Appl. No.: 12/528,834

(22) PCT Filed: Mar. 10, 2008

(86) PCT No.: PCT/EP2008/052802

§ 371 (c)(1),
(2), (4) Date: Dec. 30, 2009

(87) PCT Pub. No.: WO2008/107490

PCT Pub. Date: Sep. 12, 2008

(65) Prior Publication Data

US 2010/0101097 A1 Apr. 29, 2010

(30) Foreign Application Priority Data

Mar. 8, 2007 (DE) ..... 10 2007 012 287

(51) Int. Cl.
*B26B 7/00* (2006.01)

(52) U.S. Cl.
USPC ..... 30/276

(58) Field of Classification Search
USPC ..... 30/276, 346, 329, 347, 282, 283, 30/123, 289; 452/133, 134
See application file for complete search history.

(56) References Cited

U.S. PATENT DOCUMENTS

| | | | | | |
|---|---|---|---|---|---|
| 1,648,931 | A | * | 11/1927 | Barry | 30/276 |
| 3,150,409 | A | * | 9/1964 | Wilcox | 30/276 |
| RE25,947 | E | * | 12/1965 | Bettcher | 30/276 |
| 4,178,683 | A | * | 12/1979 | Bettcher | 30/276 |
| 4,198,750 | A | * | 4/1980 | Bettcher | 30/276 |
| 4,363,170 | A | * | 12/1982 | McCullough | 30/276 |
| 4,439,924 | A | * | 4/1984 | Bettcher | 30/276 |
| 4,492,027 | A | * | 1/1985 | Bettcher | 30/276 |
| 4,494,311 | A | * | 1/1985 | McCullough | 30/276 |
| 4,575,937 | A | * | 3/1986 | McCullough | 30/276 |
| 4,575,938 | A | * | 3/1986 | McCullough | 30/276 |
| 4,854,046 | A | * | 8/1989 | Decker et al. | 30/276 |

(Continued)

FOREIGN PATENT DOCUMENTS

| | | | |
|---|---|---|---|
| CA | 2679693 | A1 * | 9/2008 |
| CN | 101663139 | A * | 3/2010 |

(Continued)

*Primary Examiner* — Jason Daniel Prone
(74) *Attorney, Agent, or Firm* — The Webb Law Firm

(57) ABSTRACT

A cutting knife, in particular for cutting food, includes a blade being disposed rotatably about a rotation axis and a drive being designed as an electric motor, which includes a rotating rotor and a stationary stator, which interact for driving the blade and which impart a rotational movement on the blade during operation of the cutting knife. Herein, the rotor is rotatable about the rotation axis, is connected in a rotationally fixed manner with the blade and rotates during operation of the cutting knife together with the blade about the rotation axis. In this way, a cutting knife is provided which is improved with regard to its construction such that the driving of the blade is simplified and the manageability of the cutting knife is improved.

22 Claims, 17 Drawing Sheets

(56) References Cited

U.S. PATENT DOCUMENTS

| | | | | | |
|---|---|---|---|---|---|
| 4,942,665 | A | * | 7/1990 | McCullough | 30/276 |
| 5,174,099 | A | * | 12/1992 | Matsuura | 30/276 |
| 5,365,914 | A | * | 11/1994 | Wenger | 30/381 |
| 5,522,142 | A | * | 6/1996 | Whited | 30/276 |
| 5,623,764 | A | * | 4/1997 | Cseh | 30/133 |
| 5,664,332 | A | * | 9/1997 | Whited et al. | 30/276 |
| 5,692,307 | A | * | 12/1997 | Whited et al. | 30/276 |
| 5,761,817 | A | * | 6/1998 | Whited et al. | 30/276 |
| 5,940,972 | A | * | 8/1999 | Baris et al. | 30/276 |
| 6,105,351 | A | * | 8/2000 | Itoh | 30/276 |
| 6,655,033 | B2 | * | 12/2003 | Herrmann et al. | 30/276 |
| 6,662,452 | B2 | * | 12/2003 | Whited | 30/276 |
| 6,769,184 | B1 | * | 8/2004 | Whited | 30/276 |
| 6,938,348 | B2 | * | 9/2005 | Roncaglia | 30/276 |
| 7,000,325 | B2 | * | 2/2006 | Whited | 30/276 |
| 7,207,114 | B2 | * | 4/2007 | Rosu et al. | 30/276 |
| 7,340,840 | B2 | * | 3/2008 | Whited | 30/276 |
| 8,037,611 | B2 | * | 10/2011 | Levsen | 30/276 |
| 8,074,363 | B2 | * | 12/2011 | Whited | 30/276 |
| 8,250,766 | B2 | * | 8/2012 | Levsen | 30/276 |
| 8,281,493 | B2 | * | 10/2012 | Levsen | 30/276 |
| 2003/0131482 | A1 | * | 7/2003 | Long et al. | 30/276 |
| 2005/0039583 | A1 | * | 2/2005 | McNulty | 30/276 |
| 2005/0217119 | A1 | * | 10/2005 | Rapp | 30/276 |
| 2007/0283573 | A1 | * | 12/2007 | Levsen | 30/276 |
| 2008/0098605 | A1 | * | 5/2008 | Whited et al. | 30/276 |
| 2011/0185580 | A1 | * | 8/2011 | Whited | 30/276 |

FOREIGN PATENT DOCUMENTS

| | | | | |
|---|---|---|---|---|
| DE | 102007012287 | | * | 9/2008 |
| DE | 202007018892 | | * | 10/2009 |
| EP | 0689905 | A1 | | 1/1996 |
| EP | 190827 | A2 | * | 8/1996 |
| EP | 0743145 | A2 | | 11/1996 |
| EP | 2132009 | B1 | * | 10/2011 |
| ES | 2375182 | T3 | * | 2/2012 |
| JP | 2010519997 | A | * | 6/2010 |
| RU | 2009133231 | A | * | 4/2011 |
| WO | WO 2008/107490 | A1 | * | 9/2008 |

* cited by examiner

CUTTING KNIFE, IN PARTICULAR FOR CUTTING FOOD

CROSS-REFERENCE TO A RELATED APPLICATION

This application is a National Phase Patent Application of International Patent Application Number PCT/EP2008/052802, filed on Mar. 10, 2008, which claims priority to German Patent Application Number 10 2007 012 287.1, filed on Mar. 8, 2007.

BACKGROUND OF THE INVENTION

The invention relates to a cutting knife, in particular for cutting food according to the preamble of claim 1.

A cutting knife of this kind comprises a blade that is disposed to be rotatable about a rotation axis and a drive which is designed as an electric motor and comprises a revolving rotor and a stationary stator that cooperate for driving the blade and impart a rotational movement on the blade during operation of the cutting knife. A cutting knife of this kind serves for cutting food, in particular meat or fish.

A cutting knife known from EP 0 743 145 B1 is connected to an external electric drive via a flexible shaft transferring a torque, wherein the flexible shaft drives a mechanical gearing of the cutting knife, which engages via a toothed wheel in a circumferential toothing on a blade that is mounted rotatingly on the cutting knife. During operation of the cutting knife the flexible drive shaft imparts a rotational movement on the toothed wheel of the gearing, which imparts, by its engagement into the toothing on the rotatingly mounted blade, a rotational movement on the blade.

In a cutting knife known from EP 0 689 905 B1 the electric drive is transferred into the handle of the cutting knife and drives, via a drive shaft, a toothed wheel which engages in a circumferential toothing on a blade being mounted rotatingly on the cutting knife. The electrical drive in terms of an electric motor in the handle of the cutting knife is supplied with electric power by an external current supply unit in terms of a transformer, wherein the current supply unit is installed stationary and is connected via a cable of limited length with the cutting knife.

Various disadvantages arise from the arrangements of EP 0 689 905 B1 and EP 0 743 145 B1. The cutting knife of EP 0 689 905 B1 as well as of EP 0 743 145 B1 are, with regard to their construction, in particular with regard to the coupling of the electric drive with the blade, complex, prone to malfunction and service-intensive. In particular, for coupling the electric drive with the blade a gearing is required that engages, with a toothed wheel, in a toothing on the rotating blade and combs the toothing to drive the rotating blade. This causes the construction of the employed blade to be complicated, the blade requiring a toothing, which makes the manufacturing of the blade complicated and expensive. Second, the mounting of the blade and the coupling of the blade with the toothed wheel requires a permanent lubrication, which, when using the cutting knife for cutting food such as meat or fish, conventionally is done with vegetable oil, however hygienically is disadvantageous. Third, EP 0 689 905 B1 as well as EP 0 743 145 B1 require a coupling with an external drive or an external current supply unit, such that the cutting knife can be used only within a limited reach around the external drive and cannot be used in arbitrary locations, is limited during its operation in its reach and cannot be taken along arbitrarily.

SUMMARY OF THE INVENTION

It is an objective of the present invention to provide a cutting knife which is improved with regard to its construction such that the drive of the blade is simplified and the manageability of the cutting knife is improved.

This objective is achieved by an object with the features of claim 1. According to the invention, in a cutting knife of the initially mentioned kind the rotor is rotatable about the rotation axis, is connected in a rotationally fixed manner with the blade and rotates during operation of the cutting knife together with the blade about the rotation axis.

The invention emanates from the fundamental idea to provide a cutting knife that uses a direct drive and that does not require an additional gearing for coupling the electric drive with the blade. Herein, it is provided that the rotor of the drive, which is formed by the rotor and the stator, is mounted rotatably and rotates about the rotation axis, wherein the blade is coupled with the rotor and is caused to rotate together with the rotor. Rotor and stator cooperate herein electro-motorically, wherein the rotor, in operation, rotates relative to the stator and thereby drives the blade, which is connected in a rotationally fixed manner with the rotor.

A substantial advantage of the arrangement according to the invention lies in that no additional gearing for coupling the drive with the blade is required. In particular, the necessity for additional toothed wheels, which engage in a toothing of the blade, no longer exists such that, on the one hand, the construction of the drive and, on the other hand, the geometry of the blade can substantially be simplified. Because a gearing can be dispensed, the number of the required wear and tear elements of the cutting knife is substantially reduced, such that an efficient cutting knife of low friction, low maintenance and low wear is achieved. In addition, because no toothing has to be provided on the blade, the blade can be fabricated cheaper and simpler, such that in particular the costs for the operation of the cutting knife for the exchange of worn or malfunctioning blades are substantially reduced.

In addition, the blade is arranged in a rotationally fixed manner on the rotor and, hence, does not have to be mounted separately on the cutting knife, but rotates in operation together with the rotor about the stator. Thereby a lubrication of the blade is no longer required, such that it also is prevented that lubricant during operation of the coupling knife comes into contact with the blade, such that the hygienic conditions in particular for cutting food are substantially improved.

Preferably the stator, the rotor and the blade are formed essentially ring-shaped and are arranged concentrically with respect to each other. The rotor can herein be mounted with a ball bearing, in particular a ceramic ball bearing, in a rotatable fashion on the stator. By using such a ball bearing a lubrication of the rotor being mounted on the stator can completely be avoided, such that a lubrication of single parts of the cutting knife overall is no longer required. By using an open ball bearing, in particular a ceramic ball bearing or a steel ball bearing, it in addition is ensured that the bearing of the rotor on the stator comprises, without additional lubrication, a low friction and also allows for a long-life span without influencing the operability of the cutting knife.

Advantageously, the rotor is arranged as an inner rotor radially within the stator and the blade is arranged radially within the rotor on the inner side of the rotor. The stator thereby forms an outer ring, on which the internal rotor is mounted rotatably and carries on its inner side the blade. The coupling of the blade with the rotor herein is rotationally fixed, such that the blade rotates during operation of the cutting knife together with the rotor within the stator.

The blade, for fixing, can be held on the rotor in a form- or force-locking manner, wherein the connection between the rotor and the blade advantageously is formed detachably. For fixing the blade on the rotor the blade then can for example be inserted from above into the rotor and engages with the rotor for example using a snap fit, which holds the blade in a rotationally fixed manner. The snap fit can for example be formed by protrusions formed on the rotor, which engage in recesses on the blade.

In an advantageous embodiment the connection between the rotor and the blade is such that it tightens itself in operation of the cutting knife. This can be achieved for example in that the recesses on the blade, into which the protrusions of the rotor engage for fixing, are provided with a slope which is directed against the rotational direction of the rotor, such that the protrusions during a rotational movement of the rotor together with the blade run onto the slope and in this way fasten the fixing of the blade on the rotor.

According to the invention, an electric drive of the kind of a direct drive is provided whose rotor is coupled directly with the blade and thereby does not require a gearing for driving the blade. Different embodiments of electric motors with a stator and a rotor are in principle known and can be used. In a particular embodiment, to which however the invention is not limited, the drive can for example be formed like a permanently excited three-phase synchronous motor, in which permanent magnets are arranged on the rotor for a permanent excitation and anchor coils comprising anchor windings are arranged on the stator, the permanent magnets and the anchor coils interacting such that a current flow through the anchor coils causes a rotational movement of the rotor. For example, in an angular section of the stator three anchor coils may be arranged which are associated with two permanent magnets of the rotor. In that case, during operation of the cutting knife a time varying, sinusoidal current flows through each of the anchor coils, wherein the phases of the current in the anchor coils of the angular section differ such that a revolving rotary field results. The poles of the permanent magnets in the angular section are chosen such that in each case the north pole of the one permanent magnet and the south pole of the adjacent other permanent magnet in an alternating fashion point from the rotor to the stator, such that the permanent magnets generate an excitation field that interacts with the revolving rotary field of the anchor coils, such that the rotor in operation of the cutting knife follows the rotary field of the anchor coils.

According to the principle of a synchronous motor a revolving rotary field is excited in the stator by excitation of the anchor coils, the rotary field interacting with the field of the permanent magnets of the rotor for driving the rotor, wherein the rotor rotates synchronously with the rotary field of the stator. The stator herein is formed as a magnetic yoke and comprises teeth, each of which carries an anchor coil for excitation of the rotary field of the stator.

In operation of the cutting knife the anchor coils of the stator are fed with a sinusoidal current having a phase, such that a revolving rotary field on the stator results. Advantageously, the feeding of the anchor coils herein takes place via an electronic control device being arranged in the handle of the cutting knife, the electronic control device taking over on the one hand the feeding and controlling of the electric motor and on the other hand the overall operational control of the cutting knife. By arranging the electronic control device in the handle of the cutting knife on the one hand a space-efficient arrangement for the electronic control device and on the other hand a complete encapsulation of the electronic control device is provided in that the electronic control device is enclosed and covered by the handle. Such an encapsulation of the electronic control device in particular is advantageous to avoid the access of moisture and dirt into the electronic control device during operation of the cutting knife.

It is furthermore advantageous to enclose the drive, which is constituted by the rotor and the stator, into a housing for the protection against contamination. The housing herein can be designed such that it encloses the stator towards the outside and concludes the stator essentially without a gap towards the rotor, such that only the connecting of the blade with the rotor is allowed, however protecting the region between the rotor and the stator, in particular the mounting of the rotor on the stator. In this way, it can be prevented that contamination, such as for example remainders of cutting goods, can intrude into the region of the rotor and the stator. Just as well the encapsulation of the rotor and the stator by the housing allows for a simple cleaning of the cutting knife without having to disassemble the rotor and the stator.

In a refinement of the cutting knife, two switches for switching on the cutting knife can be provided on the handle, wherein the one switch is located on a back end of the handle and the other switch is located in a region of the handle, which a user touches during operation, for example a bottom side in a front region of the handle, and the cutting knife can be switched on only by simultaneously actuating both switches. An arrangement of this kind in particular is advantageous to ensure a safe start of the cutting knife, with no danger for injuries through the rotating blade existing for a user. This is achieved in that the cutting knife can be switched on only by simultaneously actuating both switches, wherein the one hand of the user must be on the first switch and the second hand of the user must be on the second switch. Because the switches are arranged in different locations on the handle, a simultaneous actuation of both switches by only one hand is prevented and it hence is ensured that both hands of the user during the start of the cutting knife indeed are arranged in the region of the switches and away from the region of the blade of the cutting knife. Of course, it in principle is also possible to provide only one switch, by which the cutting knife can be switched on and controlled.

In an advantageous embodiment, one of the switches is designed as a proximity switch, wherein the cutting knife can only be operated if one hand of the user is in proximity of this proximity switch. This embodiment is advantageous to prevent that the user during operation removes his hand from the handle of the cutting knife and brings it into the region of the blade of the cutting knife or that the cutting knife causes injuries for example when dropping. By designing the switch as a proximity switch, for example as a capacitive proximity switch or a proximity switch comprising a sensor, a control of the cutting knife becomes possible in which the cutting knife is automatically switched off as soon as the hand of the user is removed from the proximity switch. This provides a largest possible safety for the user both during the start procedure and during operation of the cutting knife.

In a preferred embodiment, the cutting knife in addition comprises a spacer, which, via an adjustment device, is connected to a stationary section, for example the handle, of the cutting knife, wherein the spacer is adjustable, using the adjustment device, relative to the blade in the direction of the rotation axis and is held via the adjustment device on the stationary section of the cutting knife. This spacer is arranged with a distance to the blade on the stationary section of the cutting knife and determines a measure for the depth of the cutting good to be cut. The cutting good is cut by the blade and is fed through between the blade and the spacer, wherein the distance between the spacer and the blade determines the depth or the thickness of the cut good. Because the spacer is connected via an adjustment device with the stationary section of the cutting knife, an advantageous connection of the spacer with the stationary section of the cutting knife is provided, in which the adjustment device fulfils a twofold function and on the one hand ensures the adjustability of the spacer relative to the cutting knife and on the other hand provides the connection of the spacer with the cutting knife. By using such an arrangement, the use of additional fixing screws for connecting the spacer with the stationary section of the cutting knife can be avoided and the connection can be achieved via the adjustment device alone.

Preferably the stationary section of the cutting knife is formed by the handle of the cutting knife, on which the spacer is arranged and on which a user can grab and guide the cutting knife.

In the cutting knife, the spacer is arranged with a distance to the blade being mounted, via the rotor, rotatably on the stator. During operation of the cutting knife the blade rotates relative to the stationary spacer, wherein the distance between the spacer and the blade defines the depth of the cutting good to be cut. Preferably, the spacer comprises a ring-shaped section, which is arranged in a substantially concentrical manner to the rotatably mounted blade, wherein, during operation, the cutting good that is to be cut or that is cut is fed through between the ring-shaped section and the blade and thereby the distance between the ring-shaped section of the spacer and the rotatably mounted blade determines the measure for the depth of the cut good.

The ring-shaped section of the spacer, which is arranged concentrically to the rotatably mounted blade, can be connected to the adjustment device via a bracket and via the adjustment device with the stationary section of the cutting knife, which for example is formed by the handle of the cutting knife. The spacer, thus, extends via the bracket from the handle into the region of the rotatably mounted blade such that the ring-shaped section of the spacer is positioned in a desired fashion relative to the blade.

Within the cutting knife according to the invention, the electric drive, which is formed by the rotor and the stator, is arranged as a direct drive immediately on the cutting knife. To supply electric power to this electric drive the cutting knife advantageously can be connected to an external energy source, which for example can be constructed as a capacitive accumulator with at least one capacitor for capacitively storing electric energy. This external energy source in the shape of the accumulator herein can be constructed to be portable, such that the accumulator during operation can be taken along by a user in a simple and easy to handle way. For operating the cutting knife, the external energy source herein is connected to the cutting knife and supplies the cutting knife with energy. After the energy resource of the energy source, which is designed as an accumulator, is exhausted, the energy source can be disconnected from the cutting knife and can be charged via an external charging station. After charging the accumulator the accumulator can then be again used for feeding the cutting knife, wherein the operation of the cutting knife can be continued also during charging by using an exchange accumulator. For such a capacitive accumulator for example high performance capacitors can be used, which withstand a large number of charging cycles without influence on their operational power, require an extremely short charging time and withstand an impulse load with large currents. Such capacitive accumulators, in particular with regard to the possible number of charging cycles and the charging time, offer advantages over conventional electrochemical accumulators.

BRIEF DESCRIPTION OF THE DRAWINGS

The idea of the invention shall subsequently be described with regard to the embodiments shown in the figures. Herein

DETAILED DESCRIPTION OF THE PREFERRED EMBODIMENTS

Figure 1:
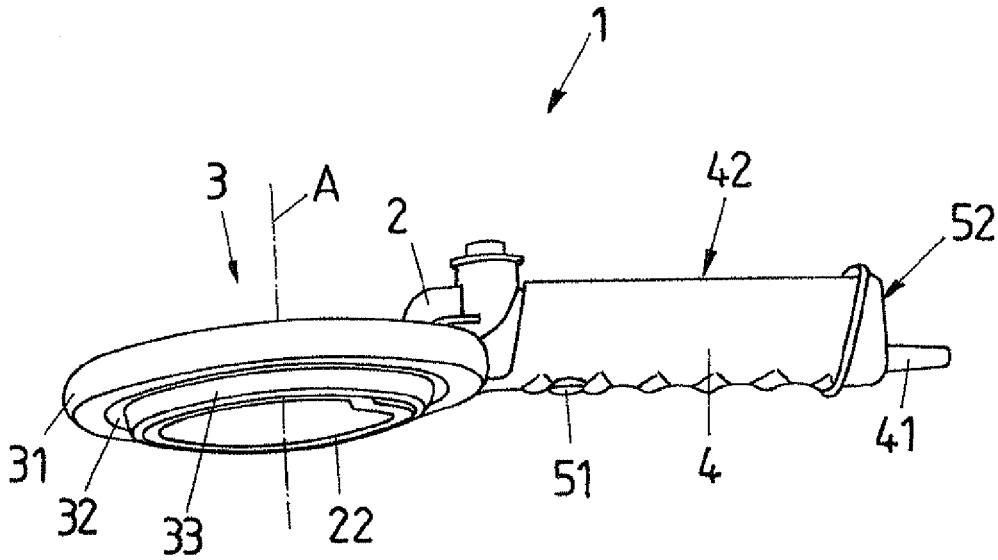
FIG. 1 shows a perspective view of a cutting knife from the side.
Figure 2:
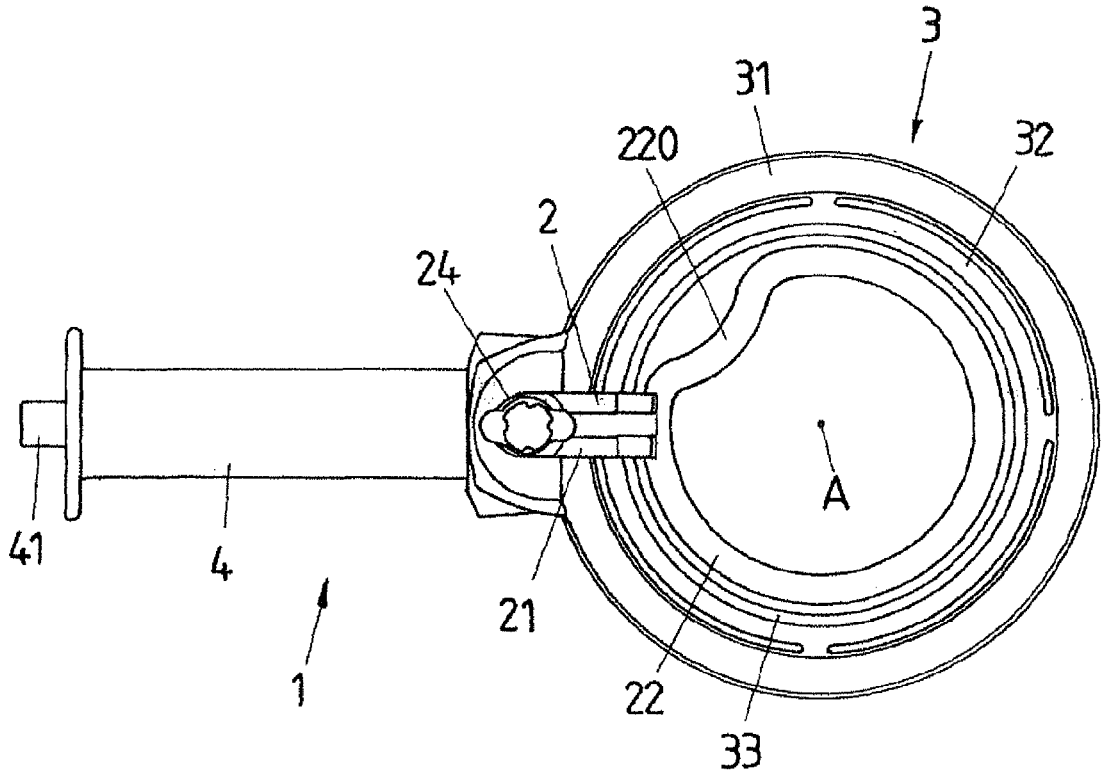
FIG. 2 shows a perspective view of the cutting knife according to FIG. 1 from above.
Figure 3:
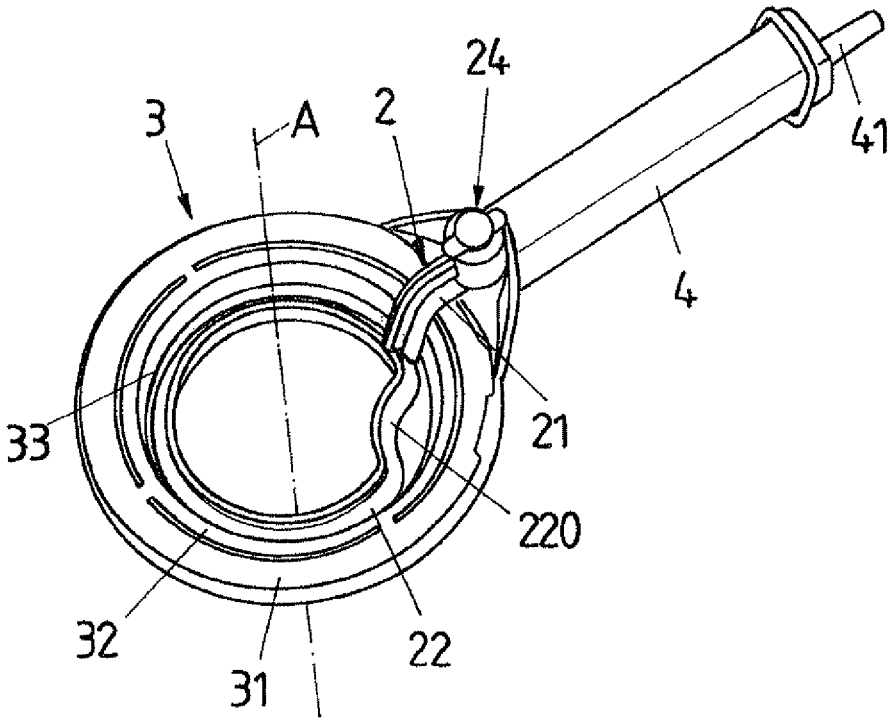
FIG. 3 shows a perspective view of the cutting knife according to FIGS. 1 and 2 at an angle from above.
Figure 4:
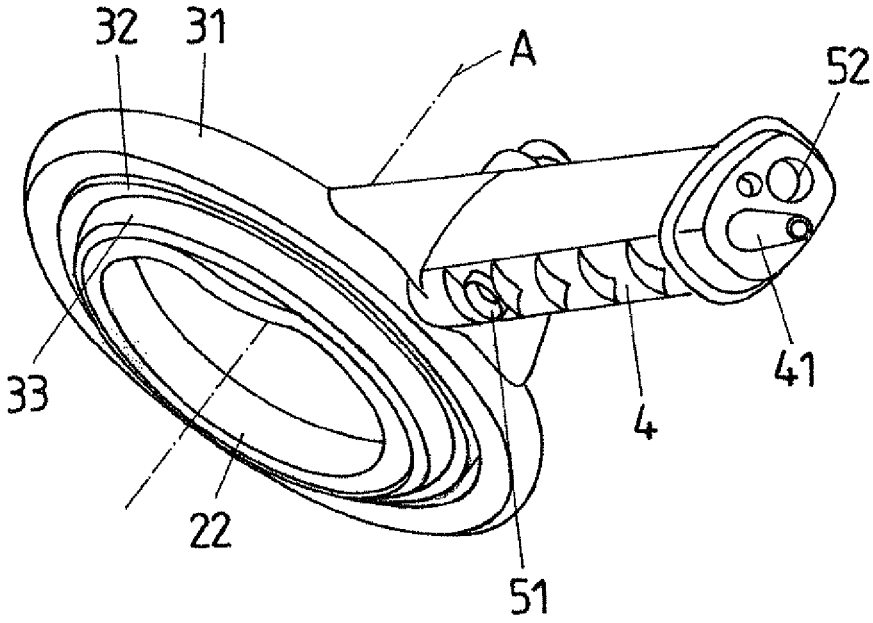
FIG. 4 shows a perspective view of the cutting knife according to FIG. 3 at an angle from below.

FIGS. 1 to 4 show an embodiment of a cutting knife 1 with a rotatable blade 33 being mounted rotatingly on the cutting knife 1, the blade 33 rotating during operation of the cutting knife 1 about an rotation axis A and being guided by a user along a product to be cut. The cutting knife 1 comprises a handle 4 on which the user can grab and guide the cutting knife 1. The cutting knife 1 serves for cutting, in particular, food such as meat or fish, is designed to be portable and can be handled with one hand by a user. The user herein grabs the cutting knife 1 on the handle 4 and guides the cutting knife 1 with the blade 33 projecting downwards along the cutting good to be cut.

During operation of the cutting knife 1 the blade 33 is driven by an electrical drive to perform a rotational movement about the rotation axis A. Within the cutting knife 1 shown in FIGS. 1 to 4, this electrical drive herein is constructed as a direct drive, which is directly coupled with the blade 33 and adjoins the front end of the handle 4. The electrical drive comprises, as for example shown in FIG. 2, an outer stator 31, a rotor 32 being mounted rotatably with respect to the stator 31 and a blade 33, which is connected to the rotor 32 in a rotationally fixed manner. The stator 31, the rotor 32 and the blade 33 together form a cutting device 3, whose rotating blade 33 during operation of the cutting knife 1 is guided along the cutting good to be cut and by which the cutting good to be processed is cut into slices.

On the handle 4 of the cutting knife 1 a spacer 2 is arranged, which is coupled, via an adjustment device 24 of the type of an adjustment screw, with the handle 4 and comprises a ring-shaped section 22, which, via a bracket 21, is connected with the adjustment device 24 and is arranged concentrically to the blade 33. The ring-shaped section 22 of the spacer 2 is arranged with a distance to the blade 33, wherein the distance between the ring-shaped section 22 and the blade 33 determines the depth or the thickness of the cutting good to be cut.

By using the adjustment device 24 the spacer 2 is connected on the one hand with the handle 4 and is held on the handle 4 and on the other hand is adjustable relative to the blade 33 in the direction of the rotation axis A, such that the distance between the ring-shaped section 22 of the spacer 2 and the blade 33 can be varied for cutting goods of different thickness. By using the adjustment device 24 the spacer 2 is fixed on the handle 4 and can be adjusted only in the direction of the rotation axis A. A displacement or an adjustment of the spacer 2 in the plane perpendicular to the rotation axis A is not possible.

The cutting knife comprises a handle 4, on which a user can grab and guide the cutting knife 1. In this context it is conceivable to provide the handle 4 with moulded recesses that can be exchanged. Dependent on the hand size of a user, different moulded recesses with different diameters can then be used, by which the handle 4 can be adapted in its diameter to the user. A user with a small hand can then for example use a moulded recess with a small diameter, whereas a user with a larger hand uses a moulded recess with a correspondingly larger diameter. By use of these different moulded recesses the handling comfort and the tangibility of the cutting knife 1 can be improved for a user.

As mentioned previously, the electric drive of the cutting knife 1 is constructed according to the type of a direct drive with a stator 31 and a rotor 32 and is provided with a blade 33 connected in a rotationally fixed manner with the rotor 32, the blade 33 being guided during operation of the cutting knife 1 along the cutting good to be processed and cutting the cutting good in the desired manner. The stator 31, the rotor 32 and the blade 33 are designed essentially ring-shaped and are arranged concentrically to the rotation axis A, about which the rotor 32 and the blade 33 coupled to the rotor 32 are rotatable.

The electric drive, consisting of the stator 31 and the rotor 32, is constructed, within the embodiment according to FIGS. 1 to 4, as a permanently excited synchronous motor and shall be described in detail in the following. However, it is acknowledged that of course instead of the embodiment of the electric drive 31, 32 specifically described here, also other configurations of electric motors, for example brush-commutated DC-motors or the like are conceivable and can be used. It is essential within the described invention that the electric drive is constructed as a direct drive, in which the rotor 32 is rotatably mounted about the rotation axis A, is connected rotationally fixed with the blade 33 and during operation of the cutting knife rotates together with the blade 33 about the rotation axis A.

In the embodiment shown in FIGS. 1 to 4, as an electric drive an electric motor according to the type of a permanently excited synchronous motor is used, which shall be explained subsequently with regard to FIGS. 5 to 12. Herein, FIGS. 5 to 7 first show partially cut views of the construction of the cutting device 3 with the stator 31, the rotor 32, the blade 33 and the spacer 2, FIG. 8 shows a schematic diagram of the operating mode of the permanently excited synchronous motor and FIGS. 9 to 12 show views of single components of the cutting device 3.

Figure 5:
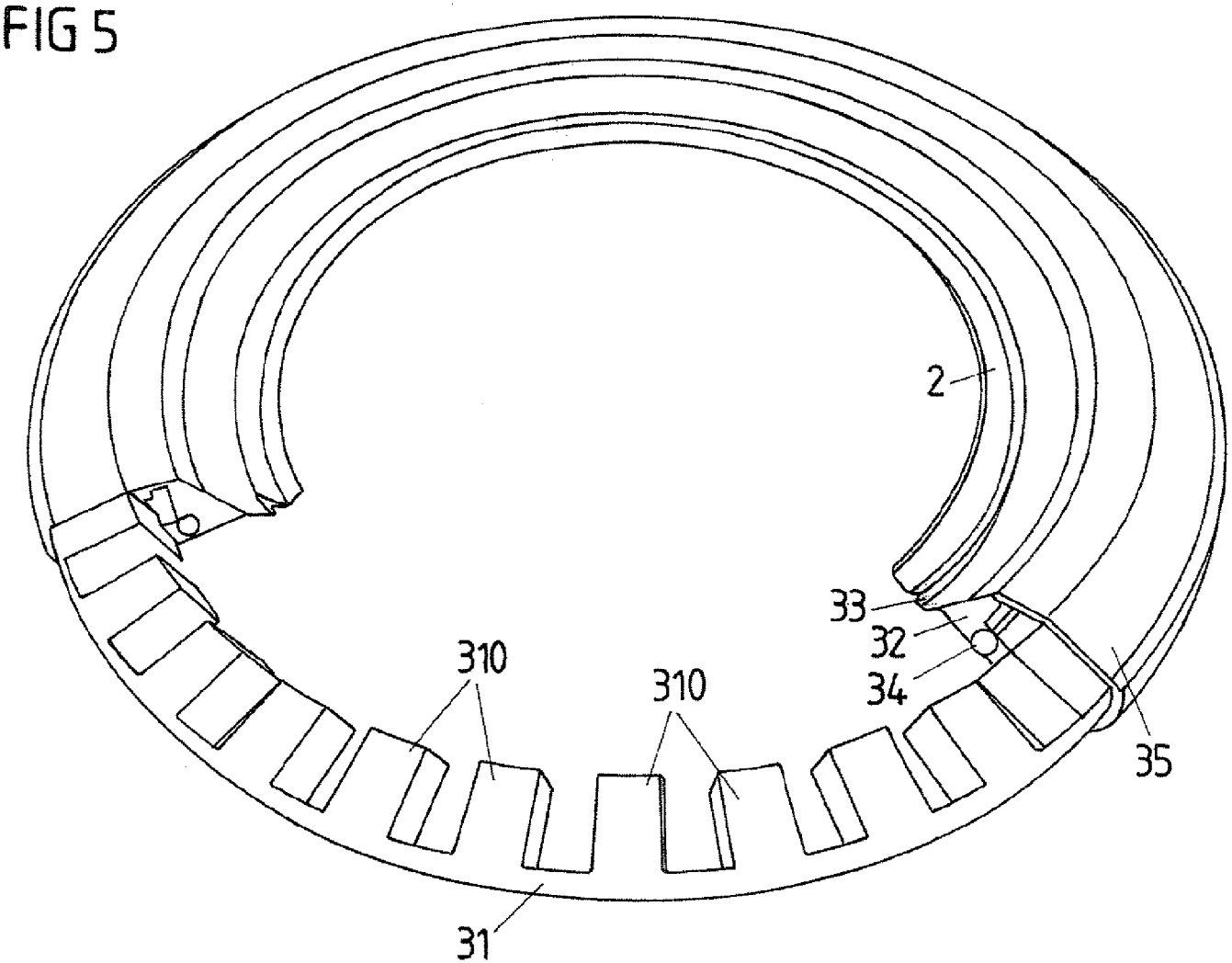
FIG. 5 shows a partially cut perspective view of the electric drive of the cutting knife comprising a stator, a rotor and a blade.
Figure 6:
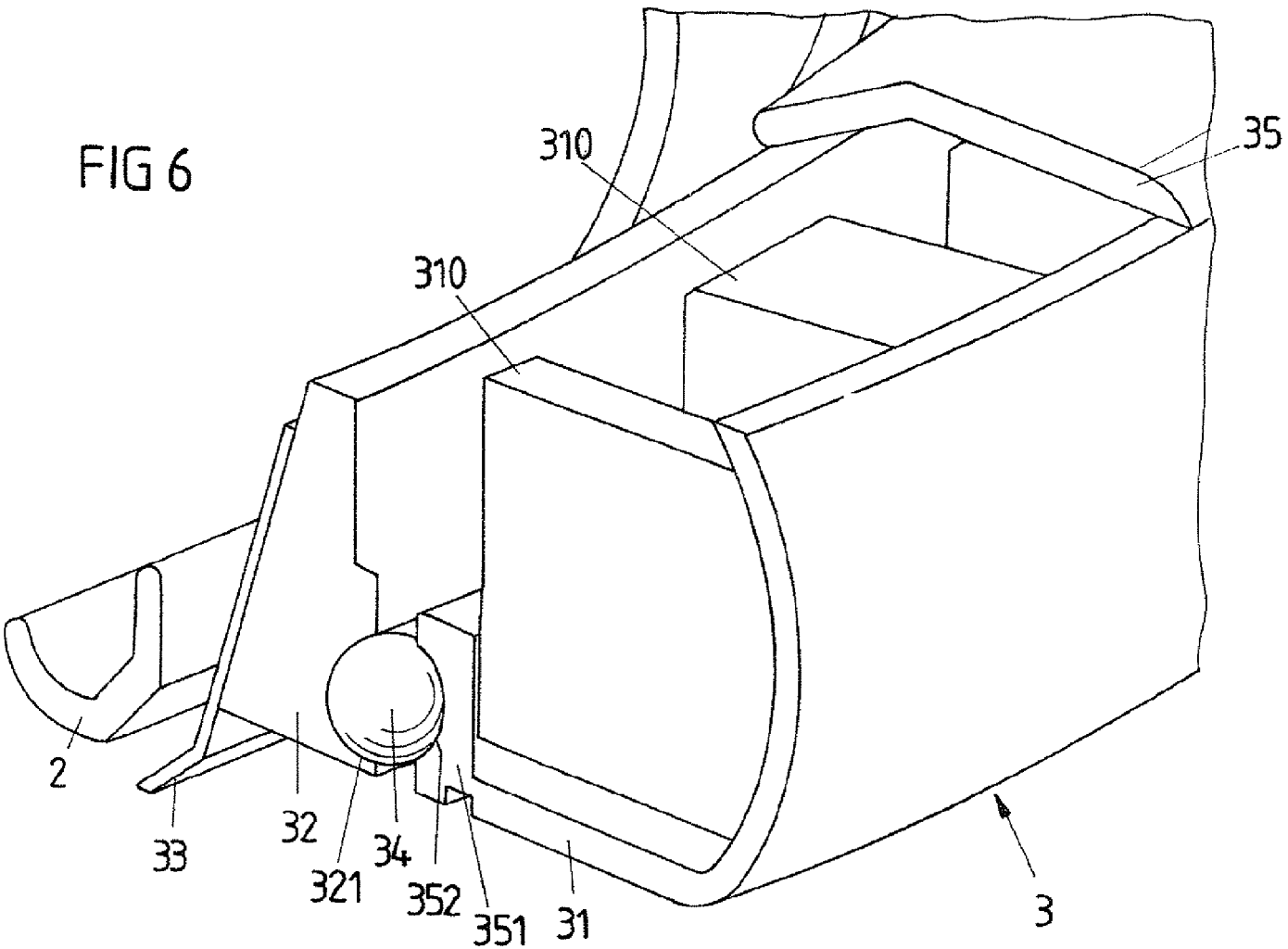
FIG. 6 shows a perspective partially cut view through the stator, the rotor and the blade.
Figure 7:
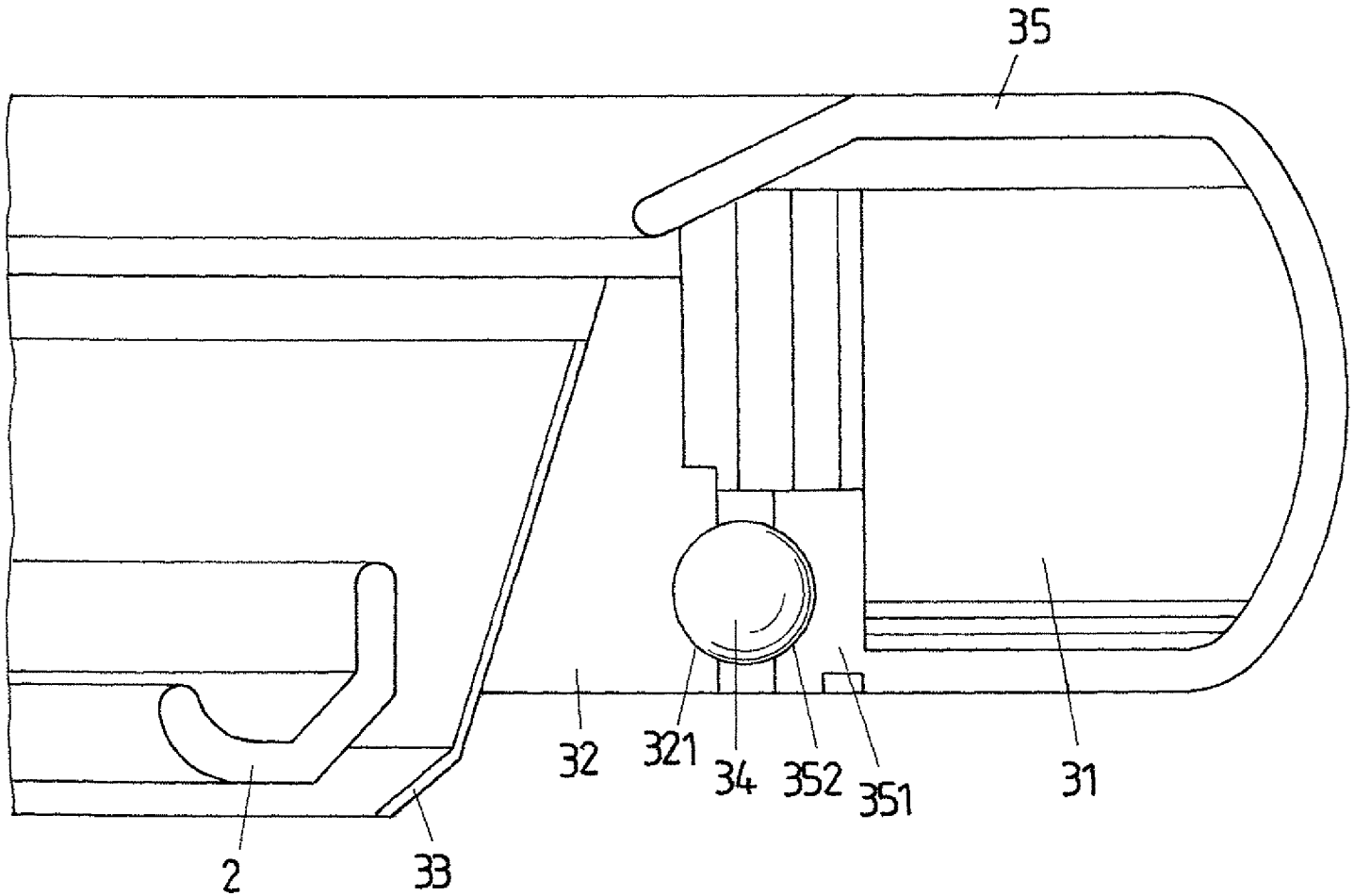
FIG. 7 shows a further partially cut view of the stator, the rotor and the blade.
Figure 8:
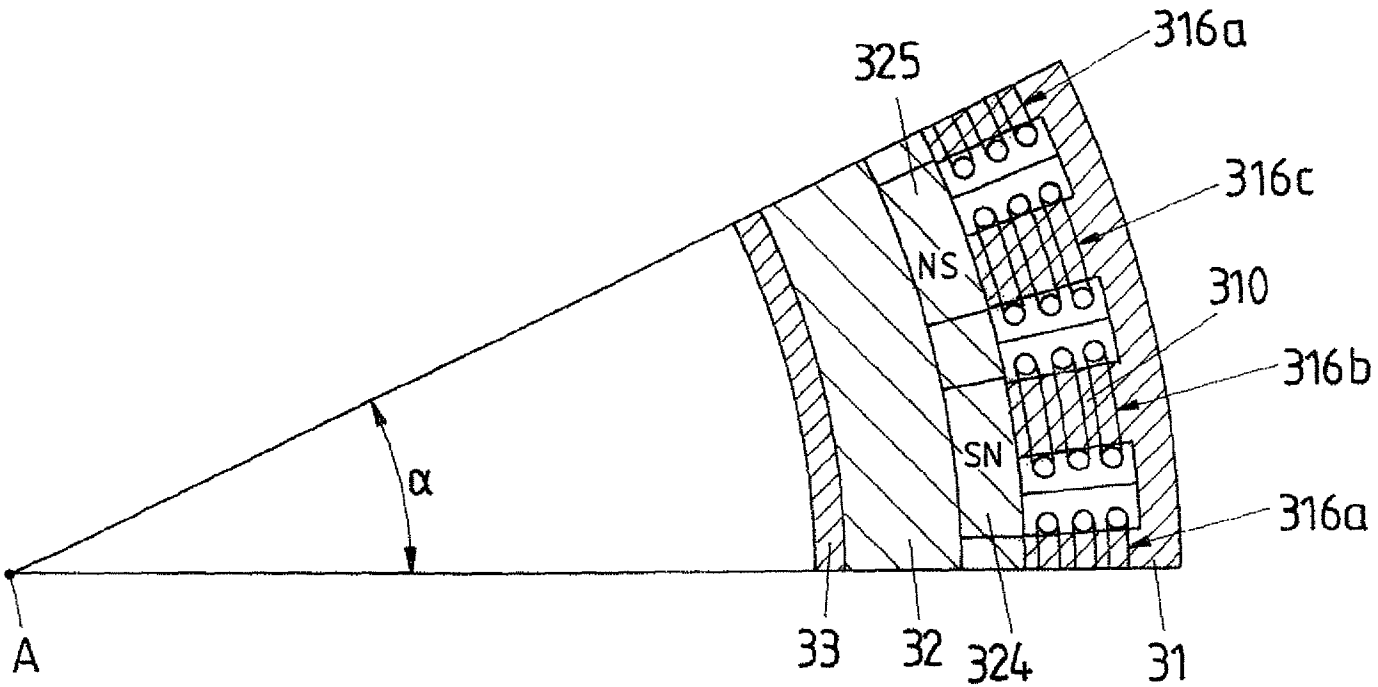
FIG. 8 shows a schematic illustration of the arrangement of the permanent magnets on the rotor and the anchor coils on the stator.

As first of all can be seen from FIGS. 5 to 7, the electric drive comprises a stator 31 and a rotor 32, which are arranged concentrically to each other, wherein the rotor 32 is mounted, via a ball bearing 34, rotatably about the rotation axis A on the stator 31. The ball bearing 34 is constructed as a ceramic ball bearing, in which the ceramic balls are arranged rolling in channels 321, 352 on the rotor 32 and on the stator 31, respectively, and provide a ball bearing between the rotor 32 and the stationary stator 31. The stator 31 is enclosed by a housing 35, which encloses the stator 31 and is separated from the rotor 32 only by a small gap (see FIG. 7). The housing 35 enclosing the stator 31 is fixedly connected with the stator 31 and comprises a bearing section 351, in which the stator-side channel 352 for the ball bearing 34 is formed.

With the ball bearing 34 for the rotatable mounting of the rotor 32 on the stator 31 an arrangement is accomplished being low in friction and almost free of wear and tear and not requiring any additional lubrication means. Through the encapsulation of the stator 31 in the housing 35 and the almost gap-free closure between the housing 35 and the rotor 32 furthermore a closed arrangement is produced which comprises minimum gaps, in which no remains of cutting goods can settle. Because in addition the encapsulation of the stator 31 and the rotor 32 and in particular the protected arrangement of the ball bearing 34 between the stator 31 and the rotor 32 allows for an easy cleaning of the cutting knife, the hygienic conditions during operation of the cutting knife are substantially improved.

On the inner side of the rotor 32, which in operation of the cutting knife 1 rotates as an inner rotor in the stator 31 about the rotation axis A, the blade 33 is arranged, which projects with a lower section (see FIGS. 6 and 7) beyond the bottom side of the rotor 32 and can, for cutting the cutting good, be brought into contact with the cutting good. Radially within the blade 33 the spacer 2 with its ring-shaped section 22 (see for example FIG. 2) is arranged and comprises a distance to the blade 33, which defines a measure for the depth or the thickness of the cutting good to be cut.

Within the electric drive, which is formed by the stator 31 and the rotor 32 and is constructed according to the type of a permanently excited synchronous motor, on teeth 310 of the stator 31 anchor coils for generating a revolving rotary field are arranged and on the rotor 32 permanent magnets for generating an excitation field are arranged. A schematic diagram of the arrangement of these anchor coils 316*a*, 316*b*, 316*c* on the stator 31 and of the permanent magnets 324, 325 on the rotor 32 is shown in FIG. 8, which shows the arrangement within an angular section a of the electrical drive. Each tooth 310 of the stator 31 carries one anchor coil 316*a*, 316*b*, 316*c* with three anchor windings 317 each, which during operation of the cutting knife are fed with a time-varying sinusoidal current. The phase of the current to the anchor coils 316*a*, 316*b*, 316*c* herein differs according to the type of three-phase synchronous motors such that a rotary field is generated that revolves about the stator 31. The hence generated rotary field interacts with the permanent magnets 324, 325 arranged on the rotor 32, which are poled opposite to each other such that the north pole N of the one permanent magnet 324 and the south pole S of the other permanent magnet 325 face towards the stator 31. In operation, the excitation field generated by the permanent magnets 324, 325 follows the rotary field generated by the anchor coils 316*a*, 316*b*, 316*c* and hence causes a synchronous rotary movement of the rotor 32 about the rotation axis A, which follows the rotary field of the stator 31.

Dependent on the phase of the currents in the single anchor coils 316*a*, 316*b*, 316*c*, the rotational direction of the rotary fields can be chosen and hence the direction of rotation of the knife can be determined. If a right-handed person uses the cutting knife 1, herein a direction of rotation of the blade 33 about the rotation axis A in a counter-clockwise sense can be advantageous, such that during operation of the cutting knife 1 the cutting knife 1 receives a force away from the user when the cutting good to be cut makes contact with the blade 33 on its front section facing away from the handle 4 (as it is usually the case). Vice versa, for a left-handed person a clockwise direction of rotation can be advantageous. It also is conceivable to configure the direction of rotation to be switchable by variably defining the phase, such that in operation of the cutting knife 1 the direction of rotation can be changed.

The arrangement of the permanent magnets 324, 325 on the rotor 32 and the anchor coils 316*a*, 316*b*, 316*c* is repeated in each case periodically in the further angular sections, wherein the phase of the currents in the anchor coils 316*a*, 316*b*, 316*c* periodically corresponds. In principle, the number of the used permanent magnets 324, 325 and anchor coils 316*a*, 316*b*, 318*c* is arbitrary, wherein, within the shown embodiment, in each case three anchor coils 316*a*, 316*b*, 316*c* are to be associated with two permanent magnets 324, 325.

The number of anchor coils 316*a*, 316*b*, 316*c* and the permanent magnets 324, 325 can be chosen for example in dependence of the power to be provided by the cutting knife 1 and the torque to be generated.

Figure 9:
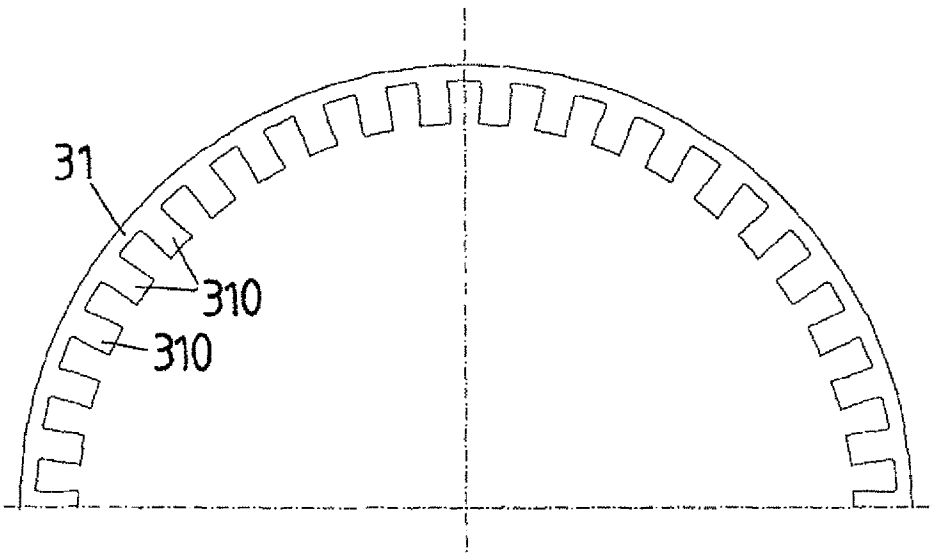
FIG. 9 shows a schematic cross-sectional view of an angular section of the stator.
Figure 10C:
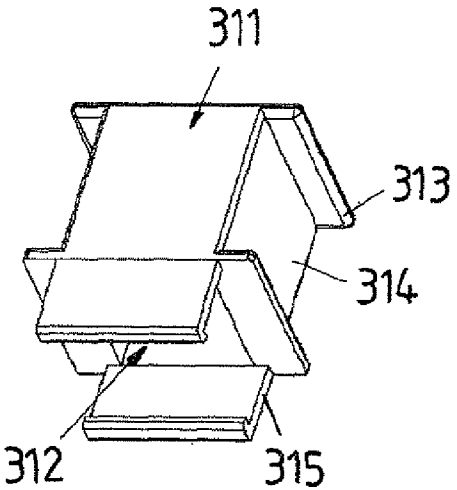
FIG. 10*a*-10*d* show separate views of the coil bodies for arranging the anchor coils on the stator.
Figure 10D:
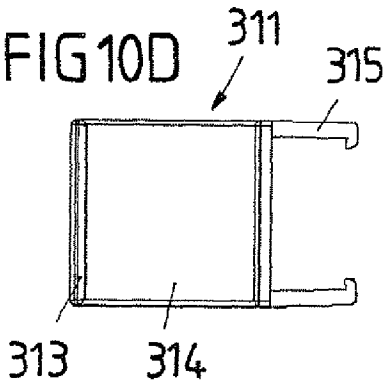
Figure 10A:
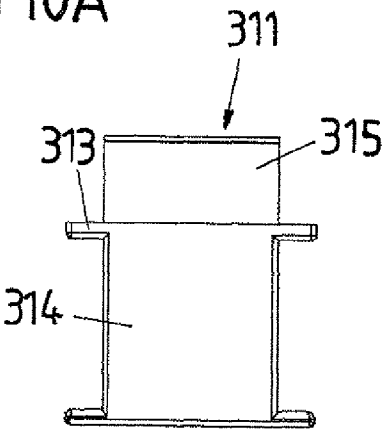
Figure 10B:
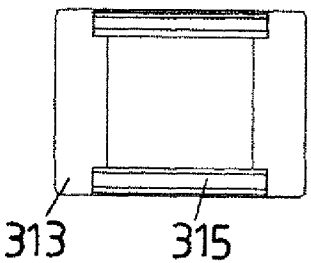
Figure 11C:
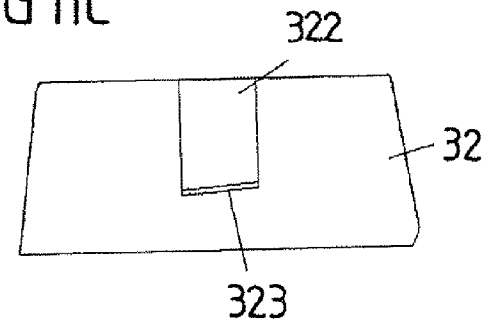
FIG. 11*c* shows a view of the rotor in section IV according to FIG. 11*b;*
Figure 11D:
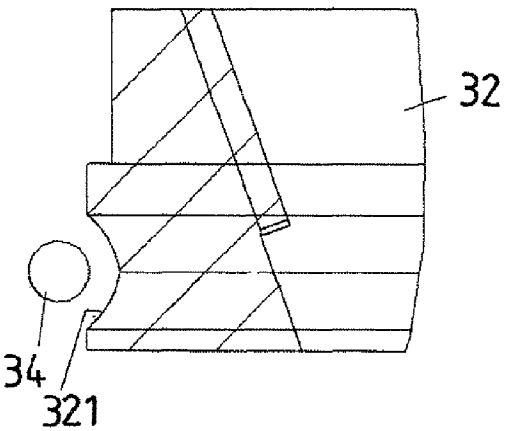
FIG. 11*d* shows a view of the rotor in section III according to FIG. 11*b;*
Figure 11A:
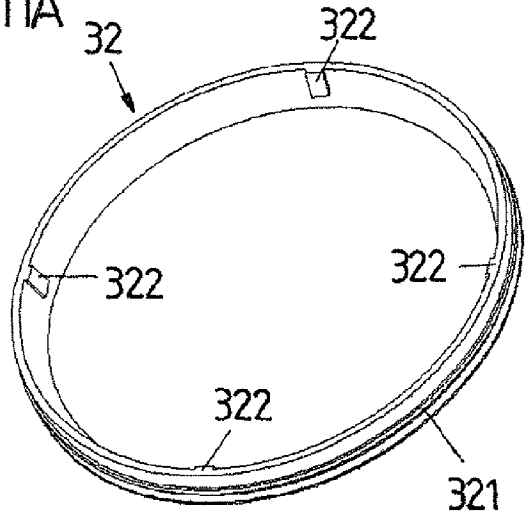
FIG. 11*a* shows a perspective view of the rotor.
Figure 11B:
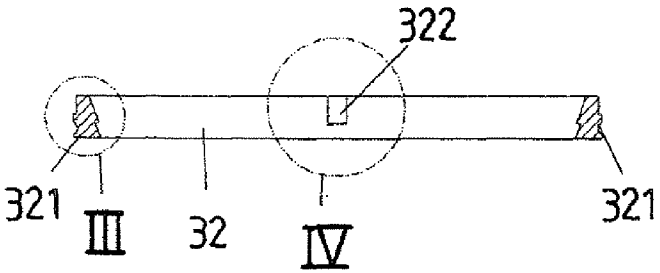
FIG. 11*b* shows a partially cut side view of the rotor.

In FIGS. 9 to 12 the elements used for the electric drive are shown in detail. FIG. 9 first shows a drawing of the stator 31, on which single teeth 310 are formed. The stator 31 is formed from multiple layers of a cut iron sheet, which are arranged above each other and form a magnetic yoke for the fields generated in stator 31 and rotor 32. The multi-layered construction of the stator 31 reduces in known fashion the eddy-current losses arising in the stator 31.

On the teeth 310 of the stator 31 the anchor coils 316*a*, 316*b*, 316*c* are arranged, as illustrated in FIG. 8. To prevent that the edges of the sheets forming the stator 31 damage the anchor windings 317 and their insulating coating, the anchor windings 317 of the anchor coils 316*a*, 316*b*, 316*c* are arranged on coil bodies 311, which in separate views are shown in FIGS. 10*a* to 10*d*. The coil bodies 311 comprise winding areas 314, onto which the anchor windings 317 are wound and on which the anchor windings 317 are held using protrusions 313. The coil bodies 311 then are pushed with the wound anchor windings 317 each on one tooth 310 of the stator 31, wherein the tooth 310 engages in a corresponding opening 312 of the coil body 311 and is held via a snap fit 315 on the stator 31.

In FIGS. 11*a* to 11*d* the configuration of the rotor 32 is shown in detail. The rotor 32, which is mounted via the ball bearing 34 rotatably on the stator 31, comprises on its side pointing radially outwards a channel 321, into which the balls of the ball bearing 34 engage to mount the rotor 32 on the stator 31. The rotor 32 is constructed essentially ring-shaped and comprises on its inner side protrusions 322, which, as is shown in the enlarged detailed views according to FIGS. 11*c* and 11*d*, project towards the inside from the inner side of the rotor 32 and comprise a sloped edge 322.

The protrusions 322 on the rotor 32 serve for fixing the blade 33 on the rotor 32. The construction of the blade 33 is shown in detail in FIGS. 12*a* to 12*d*. The blade 33 comprises, as for example can be seen from FIG. 12*b*, a top section 332, which abuts on the rotor 32, and a bottom section 333, which is bent with respect to the top section 332 and is sharpened to form a cutting edge. In operation of the cutting knife 1 the bottom section 333 (see FIG. 1) projects from the cutting device 3 and, for cutting, is brought into contact with the cutting good to be cut.

Figure 12C:
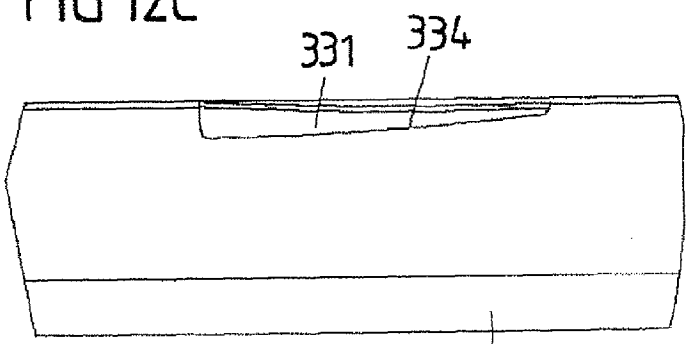
FIG. 12*c* shows a view of the blade in section VI according to FIG. 12*b;*
Figure 12D:
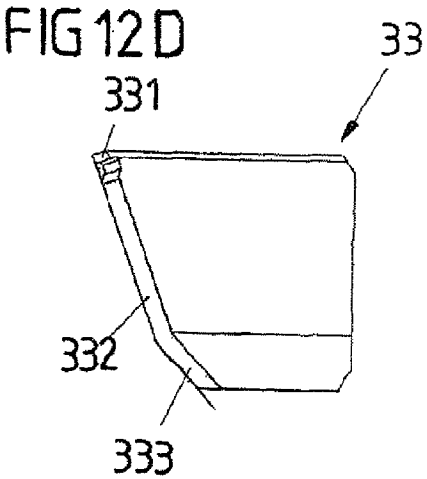
FIG. 12*d* shows a view of the blade in section V according to FIG. 12*b;*
Figure 12A:
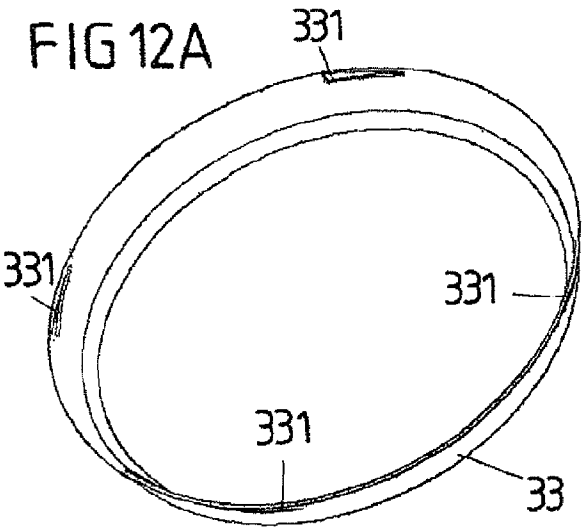
FIG. 12*a* shows a perspective view of the blade.
Figure 12B:
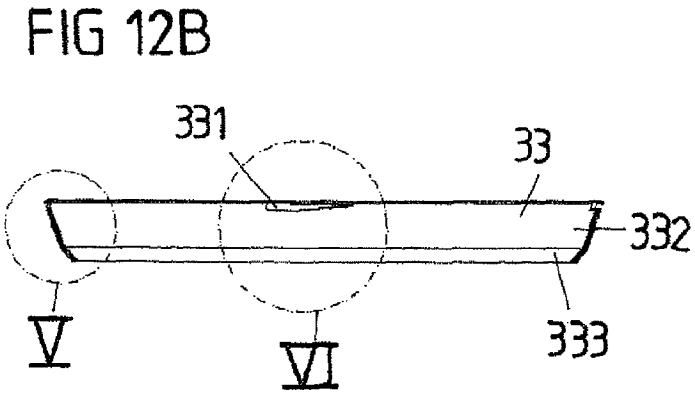
FIG. 12*b* shows a partially cut side view of the blade.

On the top edge of the top section 332 of the blade 33, as shown in FIG. 12*a*, recesses are arranged, which can be brought into engagement with the protrusions 322 on the rotor 32 for fixing the blade 33 on the rotor 32. As can be seen from the enlarged detailed view according to FIG. 12*c*, the recesses 331 also comprise a sloped edge 334, which in its slope corresponds to the slope of the edge 323 of the protrusions 322. For fixing the blade 33 on the rotor 32 the blade 33 is inserted from above (see for example FIG. 1) into the rotor 32, such that the slanted outer flanks of the top section 332 of the blade 33 abut on the correspondingly slanted inner side of the rotor 32 (see for example FIG. 6) and the recesses 331 engage with the protrusions 322 of the rotor 32.

The slopes of the edges 323, 334 on the protrusions 322 and the recesses 331, respectively, are designed such that they, in their slope, ascend against the direction of rotation of the rotor 32 and the blade 33, the recess 331 on the top edge of the blade 33 hence deepening against the direction of rotation of the blade 33. If in operation of the cutting knife 1 the rotating blade is brought into contact with the cutting good to be cut, the blade 33 experiences a resistance, through which the blade 33 turns marginally with respect to the rotor 32. Thereby the protrusions 322 each associated with the recesses 331 wander up the slope edges 334 of the recesses 331, such that the blade 33 is pressed into the rotor 32 and hence is fixed in its connection with the rotor 32. The connection between the blade 33 and the rotor 32 hence tightens itself during operation of the cutting knife 1, such that a release of the connection between the blade 33 and the rotor 32 is counteracted.

As is shown in FIGS. 1 to 4, an electric connection 41 is arranged on the handle 4 of the cutting knife 1 on the end of the handle 4 facing away from the cutting device 3, the electrical connection 41 serving for connecting the cutting knife 1 with an external current supply unit.

In the handle 4, furthermore an electronic control device 42 is arranged, which serves for feeding the electric drive, in particular for feeding the anchor coils 316*a*, 316*b*, 316*c* of the stator 31, and at the same time takes over the overall control of the operation of the cutting knife 1.

Furthermore, on the handle 4 switches 51, 52 are arranged, wherein the switch 51 is arranged on the bottom side of the handle 4 close to the end facing the cutting device 3 and the switch 52 is arranged on the back end of the handle 4 facing away from the cutting device 3. The switches 51, 52 interact such that for switching on the cutting knife 1 both switches 51, 52 must simultaneously be actuated. This requires that a user with the one hand actuates the switch 51 and with the other hand the switch 52, such that it is prevented that a hand of the user is located in the region of the cutting device 3 when starting the cutting knife 1 and the danger for injuries for a user during start-up is substantially reduced.

The switch 51 can be constructed as a proximity switch and can detect capacitively or by using a suitable sensor whether a hand of the user in operation of the cutting knife 1 is located in the proximity of the switch 51. The cutting knife 1 can be controlled such that the cutting knife 1 automatically switches off as soon as the hand of the user is removed from the switch 51. Thereby it is prevented that the blade 33 continues to rotate when for example the user accidentally drops the cutting knife 1.

The control of the switches 51, 52 can be taken over by the control device 42 being arranged in the handle 4. Furthermore, the switch 52 can be constructed as a push button or control switch, via which the speed and the power of the cutting knife 1 can be adjusted.

During operation of the cutting knife the electric feeding of the cutting knife 1 takes place via the electric connection 41 provided on the handle 4. It is conceivable herein, for example to connect the cutting knife 1 with an external, fixedly installed supply unit, for example a transformer. However, it is advantageous if for the electric supply of the cutting knife 1 external, portable energy sources in the shape of capacitive accumulators are used, which are designed to be portable, have stored energy for the operation of the cutting knife 1 and are rechargeable after exhaustion of their energy resource.

Figure 13A:
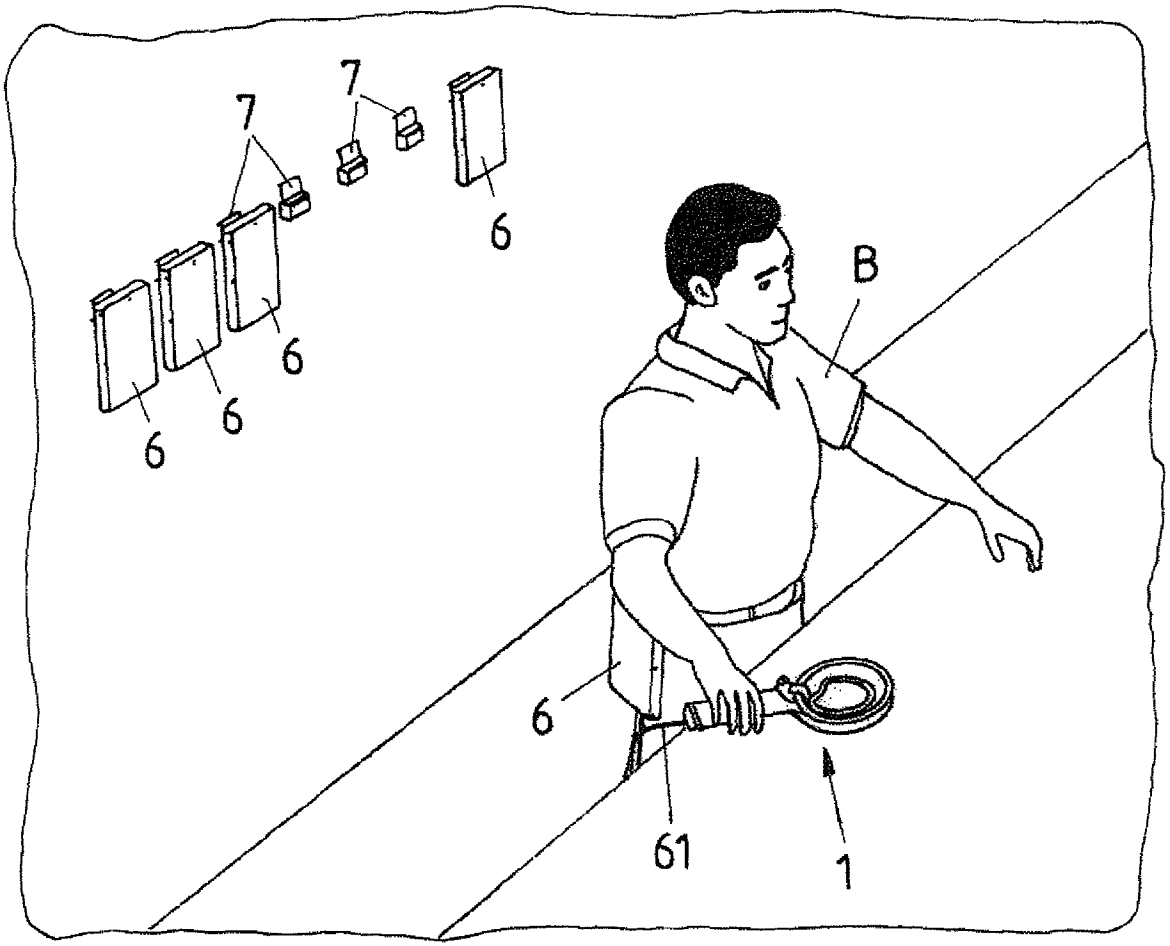
FIG. 13*a* shows a schematic illustration of the operation of the cutting knife by a user.
Figure 13B:
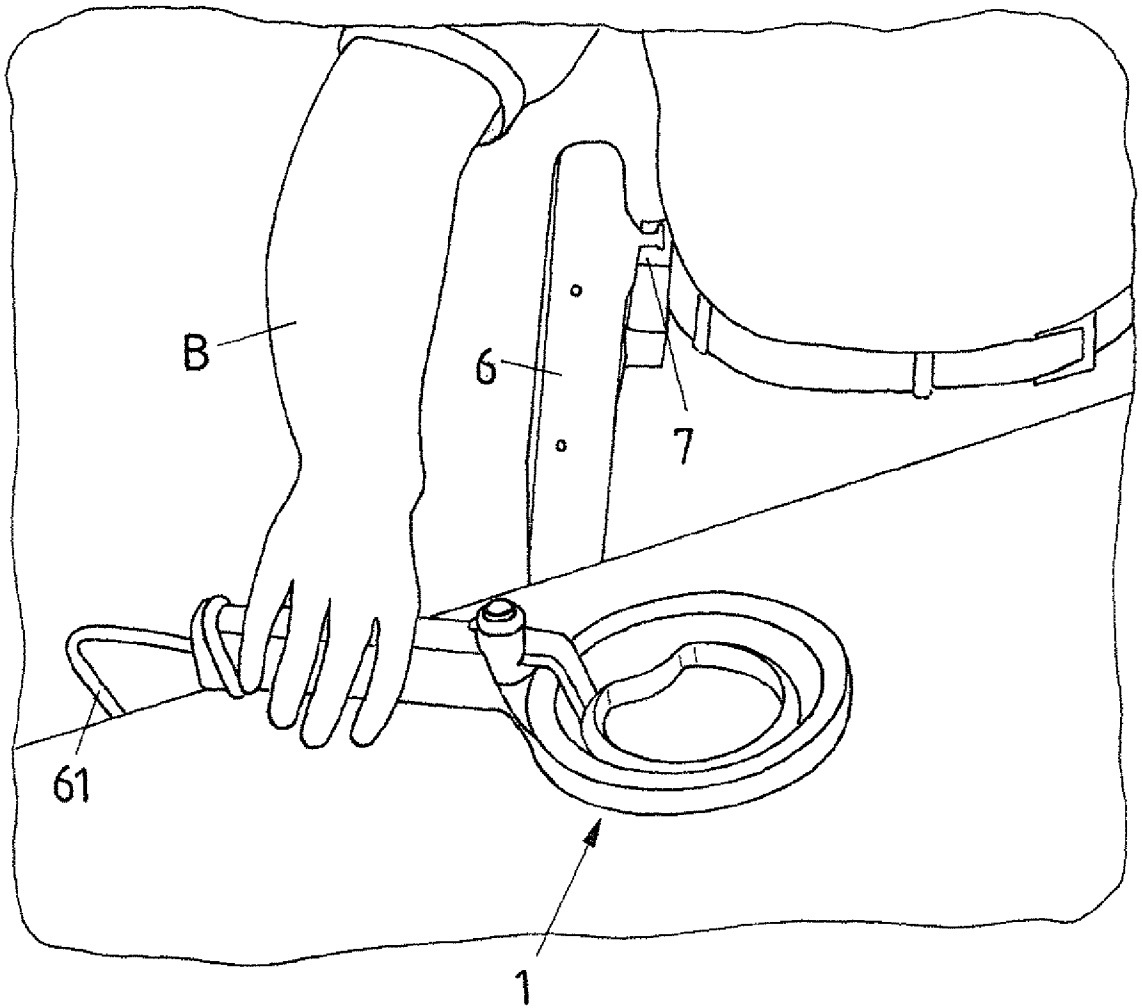
FIG. 13*b* shows an enlarged illustration of the cutting knife being operated by a user.
Figure 14:
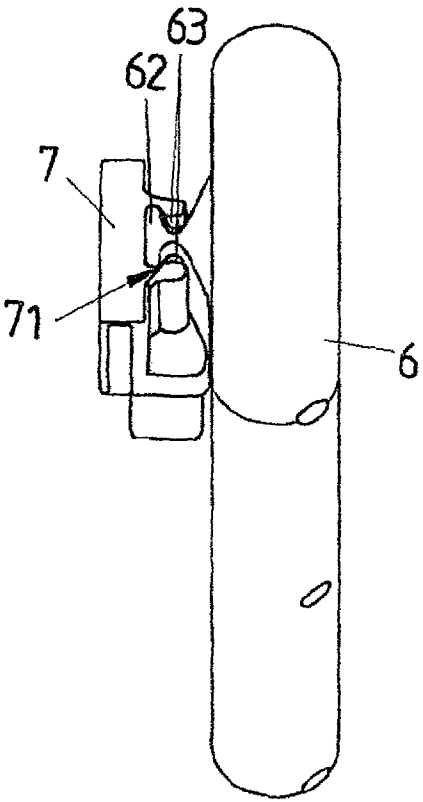
FIG. 14 shows a perspective view of an accumulator in a contact device.

An embodiment of such accumulators is shown in FIGS. 13*a*, 13*b* and 14. During operation of the cutting knife 1 an accumulator 6 is connected via a connecting line 61 with the electric connection 41 of the cutting knife 1 and supplies it with electrical energy. The accumulator 6 is constructed to be portable and can be carried by a user B for example on the belt. The accumulator is, as shown in FIG. 14, via a contact device 7 hooked onto the belt of the user B, wherein the accumulator 6 is held via a plug 62 in a receptacle 71 of the contact device 7 and is connected via contacts 63 electrically with the contact device 7. The connecting line 61 can be plugged into the contact device 7 using a plug to accomplish the connection of the accumulator 6 with the cutting knife 1.

If the energy resource of the accumulator 6 is exhausted, the user B can easily withdraw the accumulator 6 from the contact device 7 and can recharge the accumulator 6 using a charging device. To be able to continue using the cutting knife 1 during charging of the accumulator 6, a further accumulator 6 can be used and can be plugged into the contact device 7 to continue the operation of the cutting knife 1. Advantageously, the charging apparatus, as is shown in FIG. 13*a*, is arranged in the immediate neighbourhood of the working place of the user B, wherein the accumulator 6 is connected via a similar contact device 7 as it is also used for connecting the accumulator 6 with the cutting knife 1 with the charging apparatus (see FIG. 13*a* with the accumulator 6 being arranged behind the user B on a not shown charging apparatus for charging).

Figure 15:
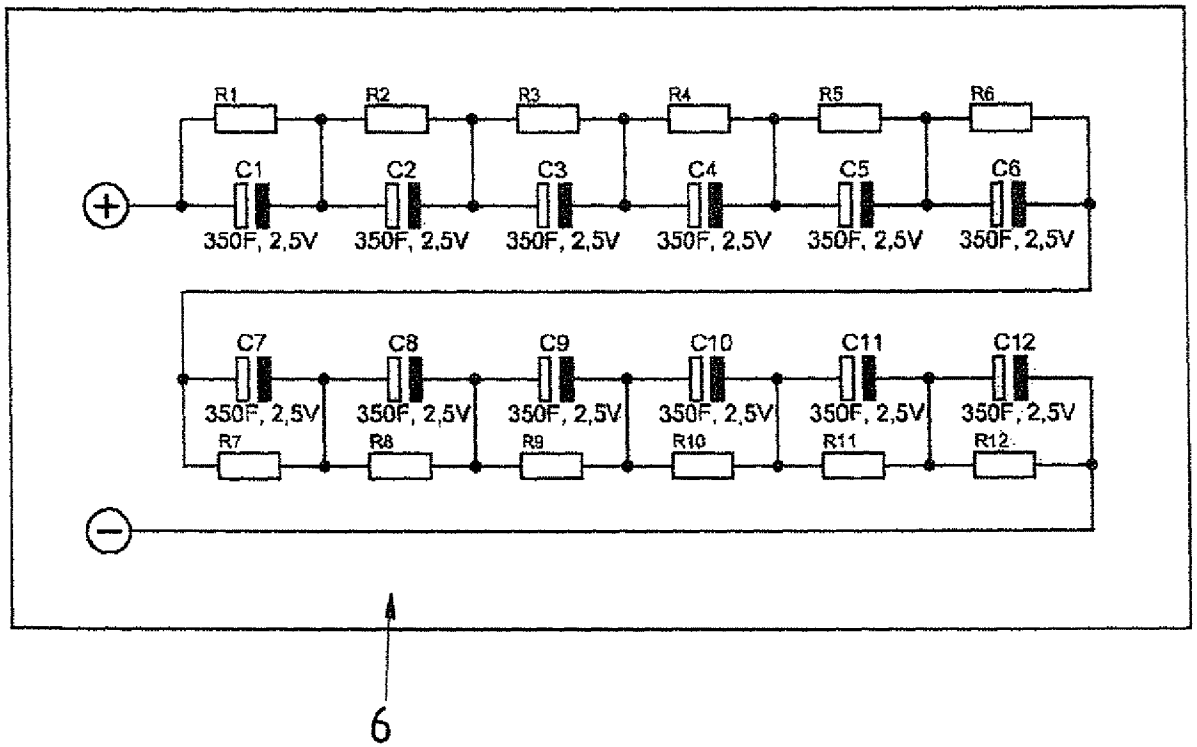
FIG. 15 shows a schematic circuit diagram of the construction of the accumulator and FIG. 16 shows a schematic circuit diagram of the construction of the charging device.

The accumulators 6 are advantageously constructed capacitively and comprise high performance capacitors with capacitances in the order of 350 Farads. A schematic diagram of a capacitive accumulator 6 is shown in FIG. 15, in which the capacitors C1 to C12, which in particular can be constructed as double-layer capacitors, are connected, each with a resistor R1 to R12 in parallel, in series and provide an output voltage on the clamps +, − which corresponds to the added voltage of the capacitors C1 to C12. Such capacitive accumulators 6 have the advantage that they allow for a large number of charging cycles, for example 500,000, require a small charging time in the order of 30 to 60 sec and in addition withstand an impulse load with large currents for charging.

Figure 16:
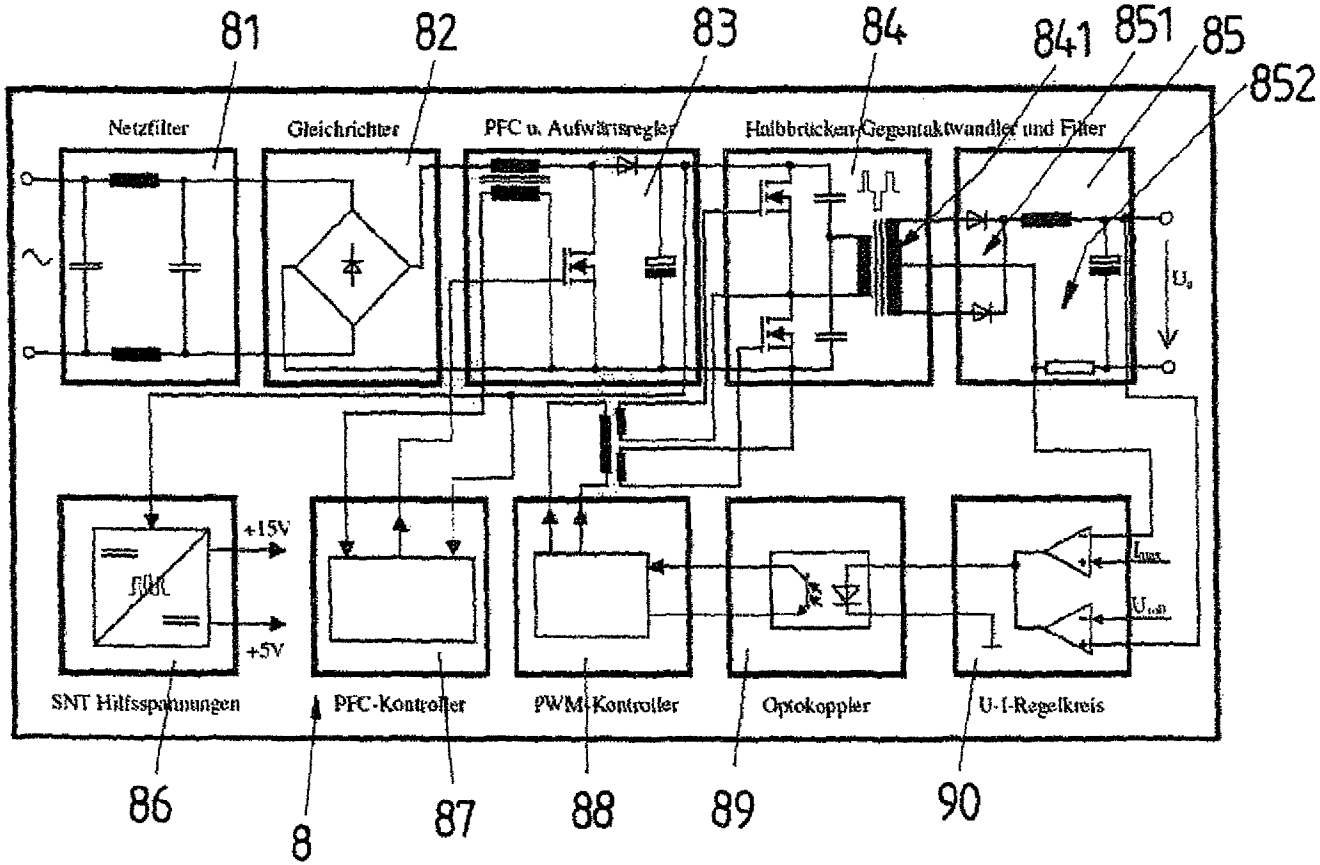

FIG. 16 shows a schematic diagram of a charging apparatus 8 for charging the capacitive accumulators 6. The charging apparatus 8 can be designed for a permanent output power of 900 W. To keep the dissipation loss and the weight as small as possible, the charging apparatus 8 is configured as a switching power supply, which, contrary to a classical linearly controlled power supply having a transformer and longitudinally controlled power transistors, on the one hand does not require a large and heavy toroidal transformer and on the other hand does not require an active cooling for the removal of the generated heat on the power transistors. The charging apparatus 8 is, with respect to its switching power supply typology, constructed as a half-bridge push-pull converter and has an active power factor correction (power factor correction, PFC).

A circuit filter 81 on the alternating voltage input prevents that high frequency interferences are transferred from the switching power supply to the power line and vice versa. The filtered alternating voltage is rectified by a rectifier 82 in the shape of a diode bridge and reaches subsequently an input stage with an active power factor correction circuit 83, which primarily causes an upward control of the input voltage and at the same time provides for an almost equal-phased current intake with respect to the input voltage. The upwardly controlled voltage serves for feeding a direct voltage intermediate circuit, which in turn provides the input voltage for a half-bridge push pole converter 84 and for an auxiliary switching power supply 86. Through the upwards control of the circuit voltage it is possible to use the charging apparatus on power lines with different voltages. The half-bridge push-pole converter 84 separates the direct voltage and generates a rectangular high frequency alternating voltage, which is transferred in a fixed relation via a high-frequency transformer 841 to the output circuit 85. The output voltage Ua, which is galvanically separated by the transformer 841, is rectified in the output circuit 85 again by a two-way rectifier 851 and a filter circuit 852 and is smoothed. For controlling the charging apparatus 8 circuits 87 to 90 in the shape of a PFC control circuit 87, a pulse width modulation control circuit 88, an optocoupler 89 and a control circuit 90 are provided. The auxiliary voltages required for the current supply of the control and monitoring circuits 87 to 90 are generated by an auxiliary switching power supply 86.

For charging, the accumulator 6 is hooked to the output clamps of the output circuit 85 and is charged via the output voltage Ua. The charging apparatus 8 is advantageously constructed in a mobile fashion to be taken along for use in different locations and to be connected on-site to the existing power line.

The idea underlying the invention is not limited to the embodiments described above, but can be applied also to completely different embodiments. In particular, the invention is not limited to the use of the described electric drive in the shape of a permanently excited synchronous motor. In addition, the use of the described cutting knife is not limited to cutting food. Conceivable is also a use of a device with an alike drive as a versatile kitchen machine, with which not only food can be cut, but which also can be used for stirring or mixing a compound. In addition it is conceivable to use the cutting knife for cutting completely different things, for example for sheep-shearing.

The invention claimed is:

1. A cutting knife, in particular for cutting food, comprising:

a blade being disposed rotatably about a rotation axis, a drive comprising a rotatable rotor and a stationary stator, wherein the rotor and the stator are operative to interact for driving the blade to impart a rotational movement on the blade during operation of the cutting knife, wherein the rotor is rotatable about the rotation axis, is connected in a rotationally fixed manner with the blade and, during operation of the cutting knife, rotates together with the blade about the rotation axis.

2. The cutting knife according to claim 1, wherein the stator, the rotor and the blade are all essentially ring-shaped and are arranged concentrically with respect to each other.

3. The cutting knife according to claim 1, wherein the rotor is rotatably mounted on the stator via a ball bearing.

4. The cutting knife according to claim 3, wherein the ball bearing is a ceramic ball bearing.

5. The cutting knife according to claim 1, wherein the rotor is, as an inner rotor, arranged radially within the stator and the blade is arranged radially within the rotor on an inside of a rotor.

6. The cutting knife according to claim 1, wherein the rotationally fixed connection between the rotor and the blade is a positive-locking detachable connection or a force-locking detachable connection.

7. The cutting knife according to claim 6, wherein the rotor and the stator are configured to tighten a connection therebetween during operation of the cutting knife.

8. The cutting knife according to claim 1, wherein the drive is a permanently excited three-phase synchronous motor, wherein permanent magnets are arranged on the rotor and anchor coils comprising anchor windings are arranged on the stator, which interact such that a current flow through the anchor coils causes the rotational movement of the rotor.

9. The cutting knife according to claim 8, wherein in an angular section of the stator, three of the anchor coils interact with two of the permanent magnets.

10. The cutting knife according to claim 8, wherein time-varying sinusoidal currents pass though the anchor coils and wherein phases of the currents in the anchor coils differ thereby generating a revolving rotary field.

11. The cutting knife according to claim 10, wherein adjacent ones of the magnets are arranged in opposite orientations such that a north pole of one of the magnets and a south pole of an adjacent one of the magnets face from the rotor towards the stator whereby the magnets generate an excitation field which interacts with the revolving rotary field where the rotor, during the operation of the knife, follows the rotary field of the anchor coils.

12. The cutting knife according to claim 1, wherein the stator is a magnetic yoke with teeth and each of the teeth carries one anchor coil.

13. The cutting knife according to claim 1, further comprising an electronic control device arranged in a handle of the cutting knife and operative for feeding anchor coils of the stator and for controlling the operation of the cutting knife.

14. The cutting knife according to claim 13, wherein the handle incorporates two switches for switching on the knife, wherein one of the switches is arranged on a back end of the handle facing away from the blade and the other switch is arranged on a portion of the handle spaced from the back end and the knife can be switched on only by simultaneously actuating both switches.

15. The cutting knife according to claim 14, wherein at least one of the switches is a proximity switch and the cutting knife can be actuated only if a hand of a user is located in a proximity of the proximity switch.

16. The cutting knife according to claim 1 further comprising a housing which at least partially encloses the drive for protection against contamination.

17. The cutting knife according to claim 1 further comprising a stationary section and a spacer, wherein the spacer is adjustably attached to the stationary section via an adjustment device.

18. The cutting knife according to claim 17 wherein the stationary section is a handle.

19. The cutting knife according to claim 17, wherein the spacer comprises a ring-shaped section, which is arranged substantially concentrical to the rotatably disposed blade.

20. The cutting knife according to claim 19 wherein the ring-shaped section of the spacer is connected to the adjustment device via a bracket.

21. The cutting knife according to claim 1, further comprising a power cord allowing the knife to be connectable for electric supply with an external energy source.

22. The cutting knife according to claim 1 wherein the drive is an electric motor.

* * * * *

UNITED STATES PATENT AND TRADEMARK OFFICE

CERTIFICATE OF CORRECTION

PATENT NO. : 8,505,207 B2
APPLICATION NO. : 12/528834
DATED : August 13, 2013
INVENTOR(S) : Gerhard Thien It is certified that error appears in the above-identified patent and that said Letters Patent is hereby corrected as shown below:

Title Page, Item (73), Assignee, Line 3, delete "Produckte" and insert -- Produkte --

Title Page 2, Column 2, Item (56), Foreign Patent Documents, Line 1, delete "102007012287" and insert -- 102007012287 A1 --

Title Page 2, Column 2, Item (56), Foreign Patent Documents, Line 2, delete "202007018892" and insert -- 202007018892 U1 --

In the Claims

Column 13, Line 7, Claim 5, delete "a" and insert -- the --

Column 13, Line 26, Claim 10, delete "though" and insert -- through --

Signed and Sealed this
Fourth Day of February, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,505,207 B2
APPLICATION NO. : 12/528834
DATED : August 13, 2013
INVENTOR(S) : Gerhard Thien It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 961 days.

Signed and Sealed this
Fifteenth Day of September, 2015

Michelle K. Lee

Michelle K. Lee
*Director of the United States Patent and Trademark Office*